US008770123B2

(12) United States Patent
Sugawara

(10) Patent No.: US 8,770,123 B2
(45) Date of Patent: Jul. 8, 2014

(54) OVERLOCK SEWING MACHINE

(71) Applicant: Juki Corporation, Tokyo (JP)

(72) Inventor: Kunihiko Sugawara, Tokyo (JP)

(73) Assignee: Juki Corporation, Tama-shi, Tokyo (JP)

( * ) Notice: Subject to any disclaimer, the term of this patent is extended or adjusted under 35 U.S.C. 154(b) by 0 days.

(21) Appl. No.: 13/915,984

(22) Filed: Jun. 12, 2013

(65) Prior Publication Data

US 2013/0333603 A1 Dec. 19, 2013

(30) Foreign Application Priority Data

Jun. 13, 2012 (JP) ..... 2012-133427

(51) Int. Cl.
*D05B 37/04* (2006.01)

(52) U.S. Cl.
USPC ..... 112/122

(58) Field of Classification Search
CPC ..... D05B 37/04; D05B 37/06; D05B 37/063; D05B 37/066
USPC ..... 112/122, 122.1, 122.2, 125, 126, 128, 112/129, 130, 162
See application file for complete search history.

(56) References Cited

U.S. PATENT DOCUMENTS 4,773,342 A * 9/1988 Fietta ..... 112/129
5,289,789 A * 3/1994 Sakuma ..... 112/122
5,427,041 A * 6/1995 Satoma ..... 112/125
5,813,356 A * 9/1998 Nolle ..... 112/122
6,101,960 A * 8/2000 Ebata et al. ..... 112/122
6,725,790 B2 * 4/2004 Sadasue ..... 112/125
6,981,458 B2 * 1/2006 Ebata et al. ..... 112/122
2005/0126459 A1 * 6/2005 Ebata et al. ..... 112/122
2006/0191453 A1 * 8/2006 Yamaguchi et al. ..... 112/199
2013/0333603 A1 * 12/2013 Sugawara ..... 112/128

FOREIGN PATENT DOCUMENTS

JP 2005-168939 A 6/2005

* cited by examiner

*Primary Examiner* — Danny Worrell
(74) *Attorney, Agent, or Firm* — Drinker Biddle & Reath LLP

(57) ABSTRACT

An overlock sewing machine includes an upper knife which is movable to a withdrawn position or a driving position, an upper knife driving unit which moves the upper knife, an interlocking switching unit which switches between an interlocking state in which the upper knife driving unit and the upper knife are interlock and a release state in which the upper knife driving unit and the upper knife are released, an upper knife position switching unit which switches the upper knife to the driving position or the withdrawn position, and an operating unit which drives the interlocking switching unit and the upper knife position switching unit such that the interlocking switching unit is brought into the interlocking state when the upper knife is switched to the driving position, and the interlocking switching unit is brought into the release state when the upper knife is switched to the withdrawn position.

4 Claims, 11 Drawing Sheets

OVERLOCK SEWING MACHINE

CROSS-REFERENCE TO RELATED APPLICATIONS

This application is based upon and claims the benefit of priority from Japanese Patent Application No. 2012-133427, filed on Jun. 13, 2012; the entire contents of which are incorporated herein by reference.

BACKGROUND OF INVENTION

1. Field of the Invention

The present invention relates to an overlock sewing machine, and in particular, to an overlock sewing machine having an upper knife which cuts a cloth end edge onto which over-edge darning is performed.

2. Related Art

For example, in an overlock sewing machine, an over-edge chain stitching is applied onto the cloth end edge while cutting a cloth end edge by an upper knife which moves up and down so as to interlock with a sewing machine main shaft.

Then, in a case where this upper knife is not used, an overlock sewing machine in which the upper knife is withdrawn from a cloth edge cutting position by stopping the upper knife on the lower side of the throat plate, that makes it easy to handle cloth on the throat plate has been known (refer to JP-A-2005-168939, for example). In this sewing machine, biasing means for biasing the upper knife always to the lower side of the throat plate is provided, and when the power transmission with a sewing machine main shaft is cut off in order to stop the upper knife, the upper knife is withdrawn to the lower side of the throat plate by the biasing force of the biasing means.

SUMMARY OF INVENTION

Meanwhile, in the sewing machine described in JP-A-2005-168939, not only are many link members (for example, a rod 4, a first crank 5, a second crank 6, a knife oscillating arm 7, an upper knife link 8, and the like) provided for power transmission from a main shaft 2 to an upper knife portion 13 of the sewing machine, but also members for withdrawing the upper knife portion 13 (for example, a first parallel link 9, a second parallel link 10, a tension spring 19, and the like), and members for canceling power transmission (for example, a knife switching lever 16, a switch coupling plate 23, a return lever part 24, and the like) are provided. Therefore, there has been a problem that the number of components and the installation space are increased. Further, because a delinking mechanism is present at a position separated from the rod 4 coupled to the sewing machine main shaft 2 at the time of forming a seam without actuating the upper knife, there are many useless operative links, which results in a heavy load on the side of the sewing machine main shaft 2, that may have an influence on its durability.

An object of the present invention is to reliably withdraw an upper knife to the lower side of a throat plate, and reduce members interlocking with a sewing machine main shaft in a state in which interlocking between the sewing machine main shaft and the upper knife is cut off at the time of withdrawal, thereby suppressing the influence on the durability with a configuration simpler than that in the conventional techniques.

(1) An overlock sewing machine of the invention includes an upper knife, an upper knife driving unit, an interlocking switching unit, an upper knife position switching unit and an operating unit. The upper knife is movable to a withdrawn position lower than a throat plate or a driving position higher than the withdrawn position, and moves up and down from above a workpiece on the throat plate to cut the workpiece at the driving position. The upper knife driving unit moves the upper knife up and down at the driving position. The interlocking switching unit switches between an interlocking state in which the upper knife driving unit and the upper knife interlock with one another and a release state in which interlocking between the upper knife driving unit and the upper knife is released. The upper knife position switching unit switches an installation position of the upper knife to the driving position or the withdrawn position. The operating unit simultaneously drives the interlocking switching unit and the upper knife position switching unit such that the interlocking switching unit is brought into the interlocking state in a case where the installation position of the upper knife is switched to the driving position by the upper knife position switching unit, and such that the interlocking switching unit is brought into the release state in a case where the installation position of the upper knife is switched to the withdrawn position by the upper knife position switching unit. The operating unit includes a rotatable shaft body, a first link section and a cam portion. The first link section rotates along with the shaft body in a state of engaging with the interlocking switching unit, to put the interlocking switching unit into motion. The cam portion rotates along with the shaft body, and engages with the upper knife position switching unit, to put the upper knife position switching unit into motion. The upper knife driving unit includes a rod and a second link section. The rod is provided with an eccentric cam rotating along with a sewing machine main shaft at one end portion, and has a notch in the other end portion. The rod oscillates by a rotation of the eccentric cam according to a rotation of the sewing machine main shaft. The second link section has an engaging portion which is capable of engaging with the notch of the rod, and oscillates so as to follow oscillation of the rod in a state in which the engaging portion engages with the notch, to drive the upper knife. The upper knife position switching unit moves the second link section so as to move the upper knife from the driving position to the withdrawn position when the cam portion engages with the upper knife position switching unit, and so as to move the upper knife from the withdrawn position to the driving position when the cam portion gets out of the engagement. When the interlocking switching unit is driven by the first link section, the interlocking switching unit moves the rod so as to detach the notch from the engaging portion to bring the interlocking switching unit into the release state, and so as to bring the notch to engage with the engaging portion to bring the interlocking switching unit into the interlocking state.

(2) The overlock sewing machine according to (1), a rotatable roller is provided at a portion contacting the rod in the interlocking switching unit.

(3) The overlock sewing machine according to (1) or (2), a biasing unit is provided for the rod to provide biasing force in a direction in which the notch and the engaging portion firmly adhere to one another.

According to the first aspect of the invention, because the interlocking switching unit is brought into an interlocking state in a case where an installation position of the upper knife is switched to a driving position by the upper knife position switching unit, and the interlocking switching unit is brought into a release state in a case where an installation position of the upper knife is switched to a withdrawn position by the upper knife position switching unit, the interlocking between the sewing machine main shaft and the upper knife is cut off in a state in which the upper knife is withdrawn to the lower side of the throat plate.

In this release state, because the notch in the rod in the upper knife driving unit is detached from the engaging portion of the second link section, to be brought into a non-engaging state, only the rod operates so as to interlock with the sewing machine main shaft. In this way, if there is only the rod as a member interlocking with the sewing machine main shaft in a release state, it is possible to suppress the influence on the durability.

Then, because members performing power transmission from the sewing machine main shaft to the upper knife are only the rod and the second link section, it is possible to reduce the number of components and save space.

According to the second aspect of the invention, because the rotatable roller is provided at the portion contacting the rod in the interlocking switching unit, even if the rod oscillates so as to interlock with the sewing machine main shaft in a release state, it is possible to allow friction due to the oscillation to escape by the roller.

According to the third aspect of the invention, because the biasing means for providing biasing force in the direction in which the notch and the engaging portion firmly adhere to one another is provided for the rod, it is possible to strengthen the engagement by the biasing force of the biasing means when the notch and the engaging portion are engaged, and it is possible to ensure power transmission from the sewing machine main shaft to the upper knife.

DETAILED DESCRIPTION

Hereinafter, an embodiment of the present invention will be described in detail with reference to the drawings.

Figure 1:
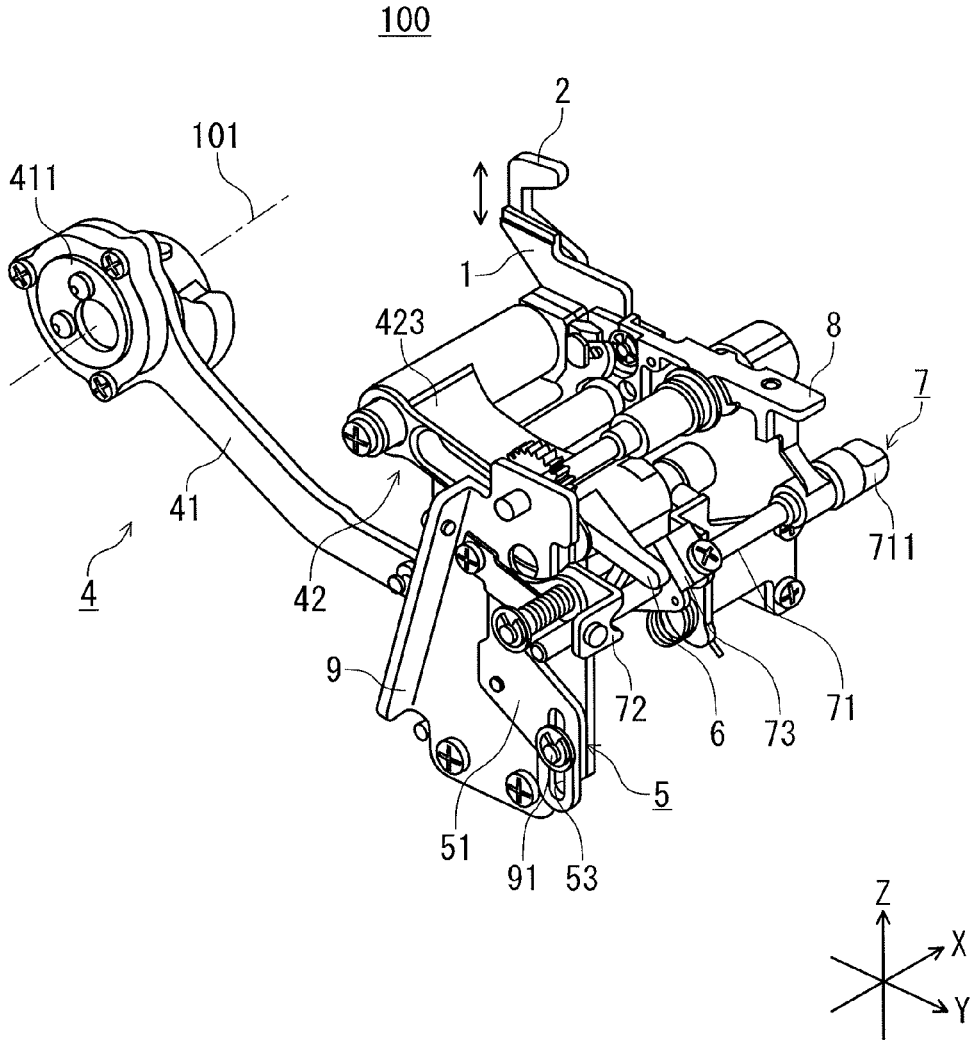
FIG. 1 is a perspective view showing a configuration of main portions of a sewing machine according to a present embodiment.
Figure 2:
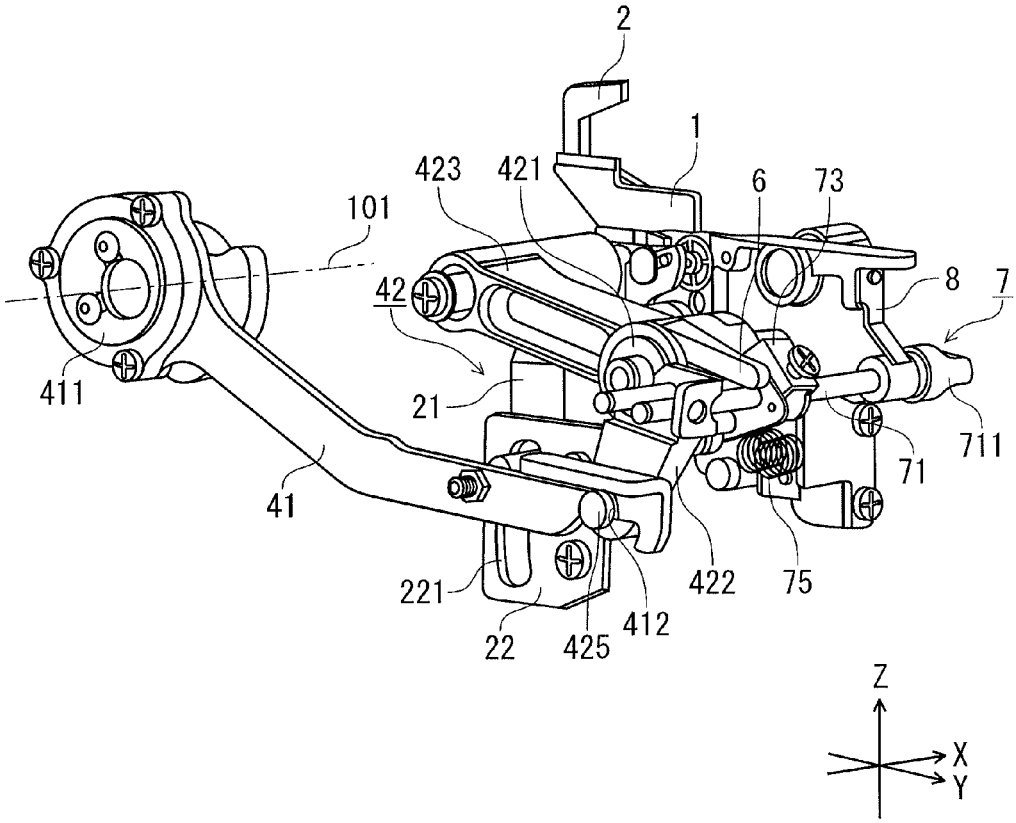
FIG. 2 is a perspective view showing a configuration of the main portions of the sewing machine according to the present embodiment.
Figure 3:
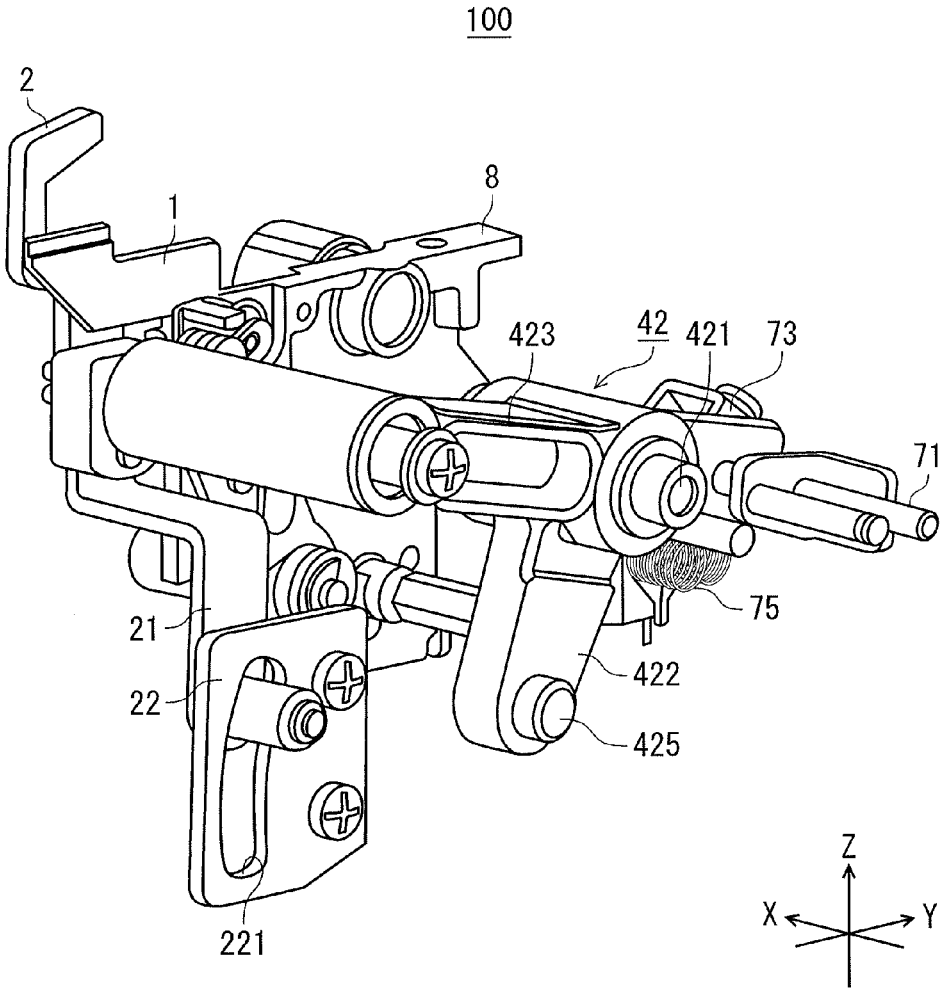
FIG. 3 is a perspective view showing a configuration of the main portions of the sewing machine according to the present embodiment.
Figure 4:
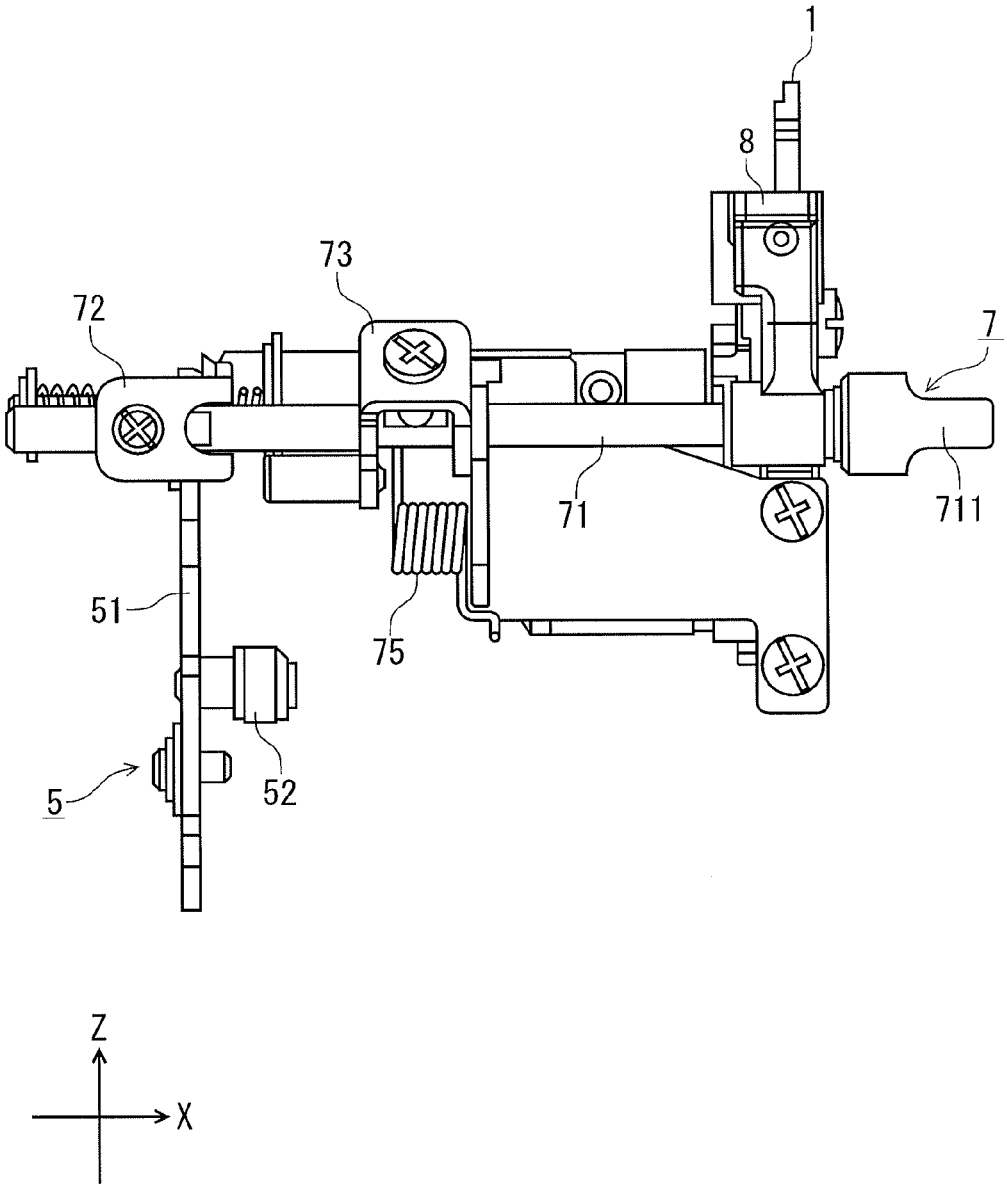
FIG. 4 is a front view showing a configuration of the main portions of the sewing machine according to the present embodiment.
Figure 5:
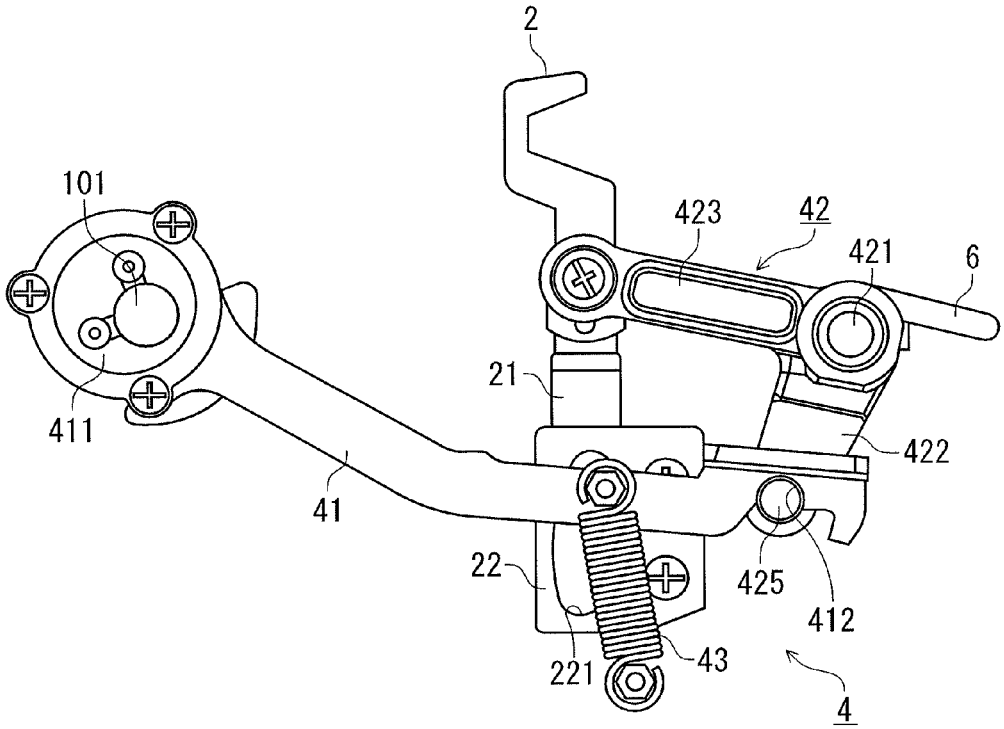
FIG. 5 is a diagram of one side showing a configuration of the main portions of the sewing machine according to the present embodiment.
Figure 5:
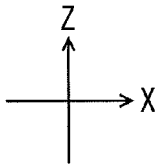
Figure 6:
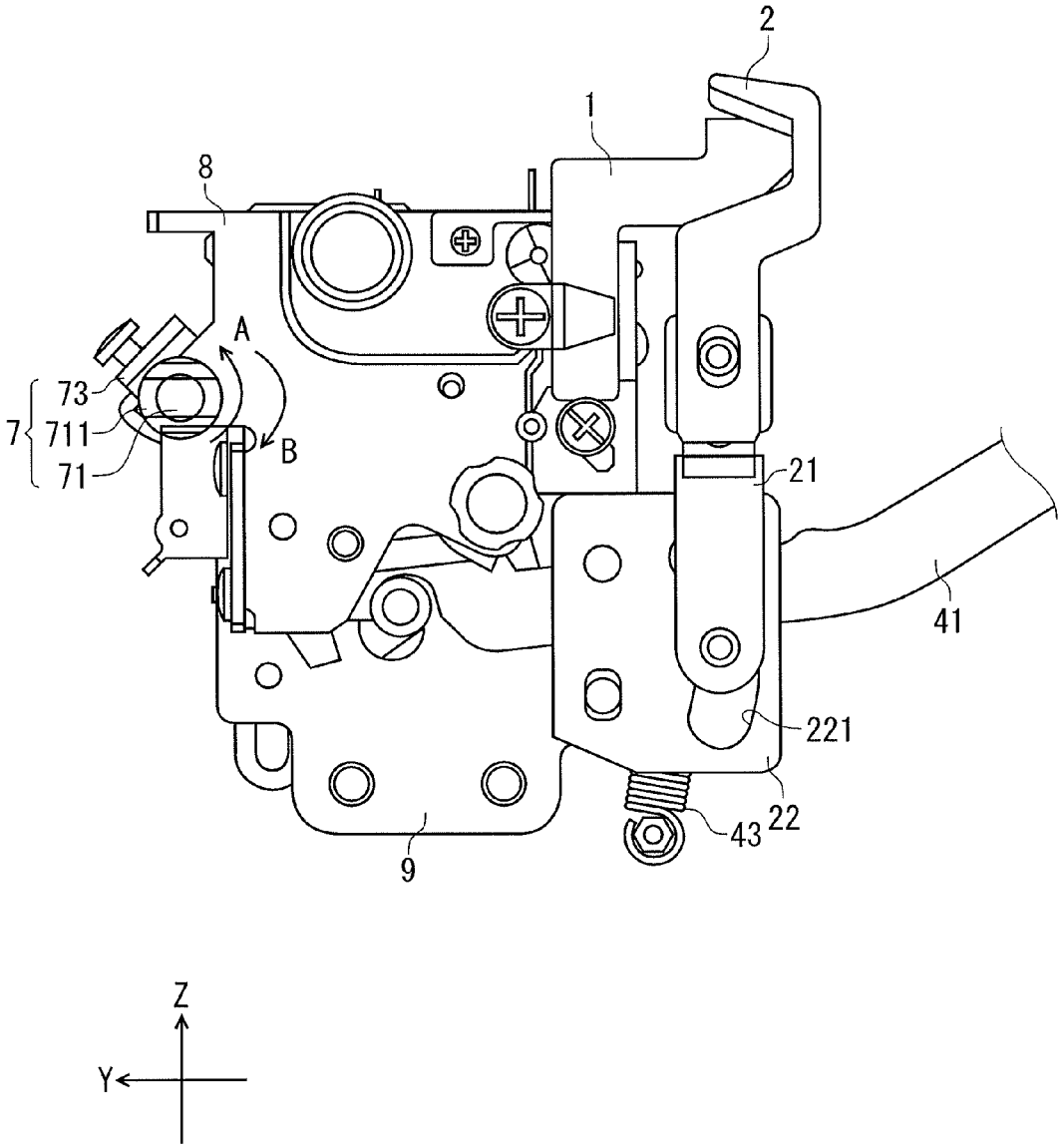
FIG. 6 is a diagram of the other side showing a configuration of the main portions of the sewing machine according to the present embodiment.

FIGS. 1 to 3 are perspective views of a configuration of main portions of an overlock sewing machine (hereinafter called a sewing machine) according to the present embodiment, which are respectively viewed from different directions. Further, FIG. 4 is a front view showing the configuration of the main portions of the sewing machine, FIG. 5 is a diagram of one side thereof, and FIG. 6 is a diagram of the other side thereof.

In addition, a direction parallel to a sewing machine main shaft 101 is defined as an X direction, a direction perpendicular to the X direction on a horizontal plane is defined as a Y direction, and a direction perpendicular to the X direction on a vertical plane is defined as a Z direction.

As shown in FIGS. 1 to 6, a sewing machine 100 includes a lower knife 1, and an upper knife 2 which is movable to a withdrawn position lower than a throat plate 3 (refer to FIG. 7) or a driving position higher than the withdrawn position, and which moves up and down from above a workpiece on the throat plate 3 to be able to cut the workpiece at the driving position, an upper knife driving unit 4 which moves the upper knife 2 up and down, an interlocking switching unit 5 which switches between an interlocking state in which the upper knife driving unit 4 and the upper knife 2 interlock with one another and a release state in which interlocking between the upper knife driving unit 4 and upper knife 2 is released, an upper knife position switching unit 6 which switches an installation position of the upper knife 2 to the driving position or the withdrawn position, an operating unit 7 which simultaneously drives the interlocking switching unit 5 and the upper knife position switching unit 6 such that the interlocking switching unit 5 is brought into an interlocking state in a case where the installation position of the upper knife 2 is switched to the driving position by the upper knife position switching unit 6, and the interlocking switching unit 5 is brought into a release state in the case where the installation position of the upper knife 2 is switched to the withdrawn position by the upper knife position switching unit 6, and a pair of frames 8 and 9 with a predetermined space in order to support these.

The lower knife 1 is fixed to the frame 8 to be close to the throat plate 3 so as not to project from the top surface of the throat plate 3.

The upper knife 2 is fixed by an upper knife holder 21. The upper knife holder 21 is retained so as to be liftable up and down by an upper knife guide 22 supported by the frame 8. A long hole 221 extending in a curving manner in the vertical direction is formed in the upper knife guide 22 in order to guide the upper knife holder 21 in the vertical direction (Z direction). The length of the long hole 221 is set to a length in which the upper knife 2 is capable of moving from the driving position to the withdrawn position.

The operating unit 7 is disposed so as to extend in parallel with the X direction, and includes a shaft body 71 supported rotatably by the frames 8 and 9, a cam portion 73 which is attached to the shaft body 71, and a first link section 72 which is attached to the shaft body 71 with a predetermined space from the cam portion 73.

A handle part 711 for rotating the shaft body 71 is attached to one end portion of the shaft body 71. This handle part 711 may be manually operated or may be mechanically operated.

The cam portion 73 rotates along with the shaft body 71, and engages with the upper knife position switching unit 6, to put the upper knife position switching unit 6 into motion. In the cam portion 73, a pin portion 74 projecting in parallel with the shaft body 71, and a coil spring 75 which provides biasing force in a predetermined direction to the cam portion 73 are provided.

The first link section 72 rotates along with the shaft body 71 in a state of engaging with the interlocking switching unit 5, to put the interlocking switching unit 5 into motion.

The upper knife driving unit 4 includes a rod 41 which oscillates so as to interlock with the sewing machine main shaft 101, and a second link section 42 which oscillates so as to follow the oscillation of the rod 41, to drive the upper knife 2.

An eccentric cam 411 which rotates along with the sewing machine main shaft 101 is provided for one end portion of the rod 41. Therefore, the entire rod 41 oscillates due to a rotation of the eccentric cam 411 according to a rotation of the sewing machine main shaft 101.

Further, a notch 412 concave upward is formed in the lower portion of the other end portion of the rod 41.

Further, in the rod 41, a spring 43 serving as biasing means for providing biasing force in a direction in which the notch 412 and an engaging portion 425 (which will be described later) firmly adhere to one another is bridged between the sewing machine frames (not shown) with respect to the rod 41.

The second link section 42 includes a rotary shaft 421 parallel to the X direction, a base portion 422 extending downward from the rotary shaft 421, and an arm portion 423 which extends from the rotary shaft 421 to the upper knife holder 21, to be coupled to the upper knife holder 21.

The engaging portion 425 which is capable of engaging with the notch 412 of the rod 41 is attached to the base portion 422. This engaging portion 425 is formed into a circular cylindrical shape extending in parallel to the X direction. In a state in which the engaging portion 425 engages with the notch 412, the engagement between the both is strengthened by the spring 43. When the rod 41 oscillates in this state, the second link section 42 oscillates so as to follow the oscillation of the rod 41 around the rotary shaft 421. At the time of oscillation, because the upper knife holder 21 coupled to the arm portion 423 is lifted up and down while being guided by the upper knife guide 22, the upper knife 2 slides in the vertical direction with respect to the lower knife 1. A cloth edge is to be cut by the cooperation of the upper knife 2 and the lower knife 1 by this sliding.

The upper knife position switching unit 6 is integrally formed with the second link section 42 so as to extend to the opposite side of the arm portion 423 from the rotary shaft 421. When the cam portion 73 of the operating unit 7 rotates up to a predetermined position, the pin portion 74 engages with the upper knife position switching unit 6.

Figure 7:
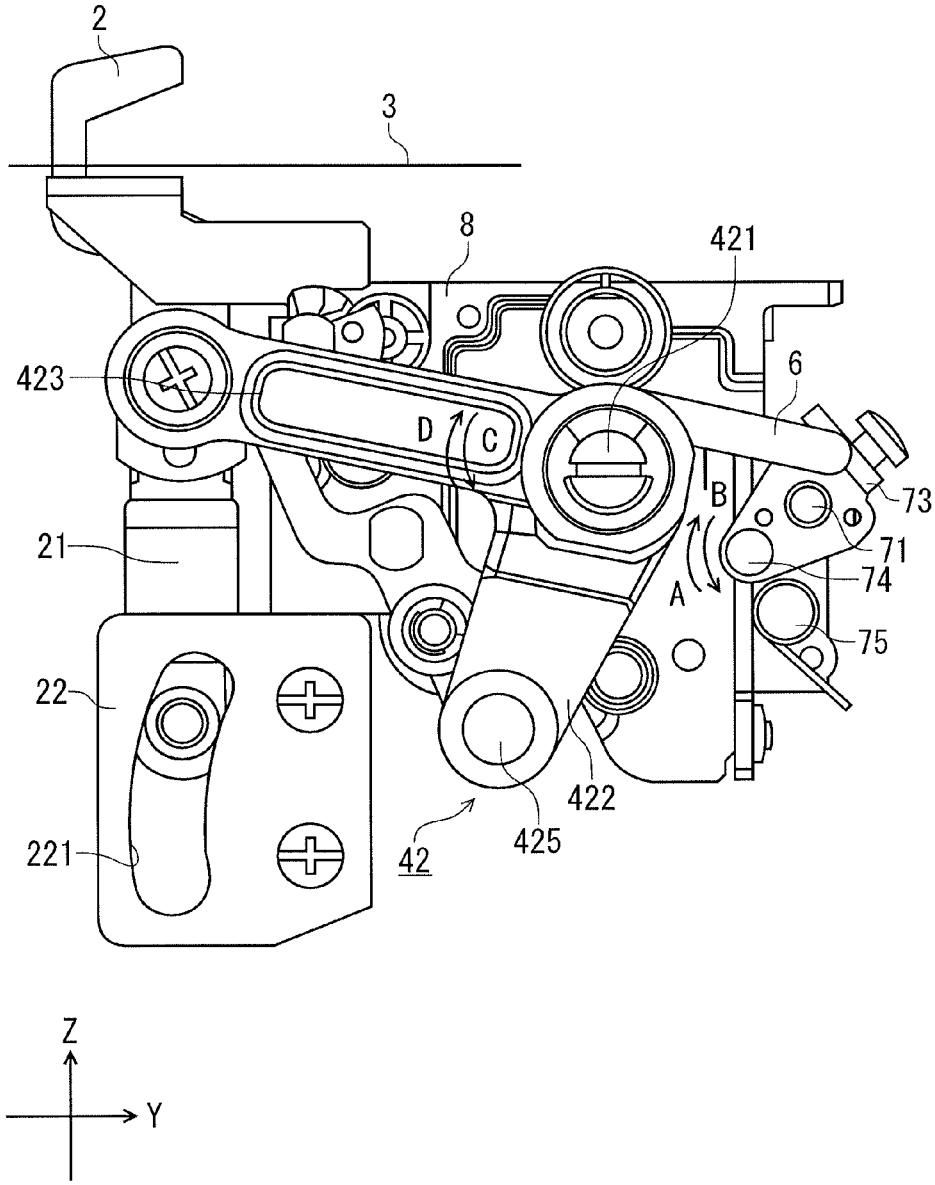
FIG. 7 is a side view showing a state in which a pin portion of an operating unit is not in contact with an upper knife position switching unit, according to the present embodiment.
Figure 8:
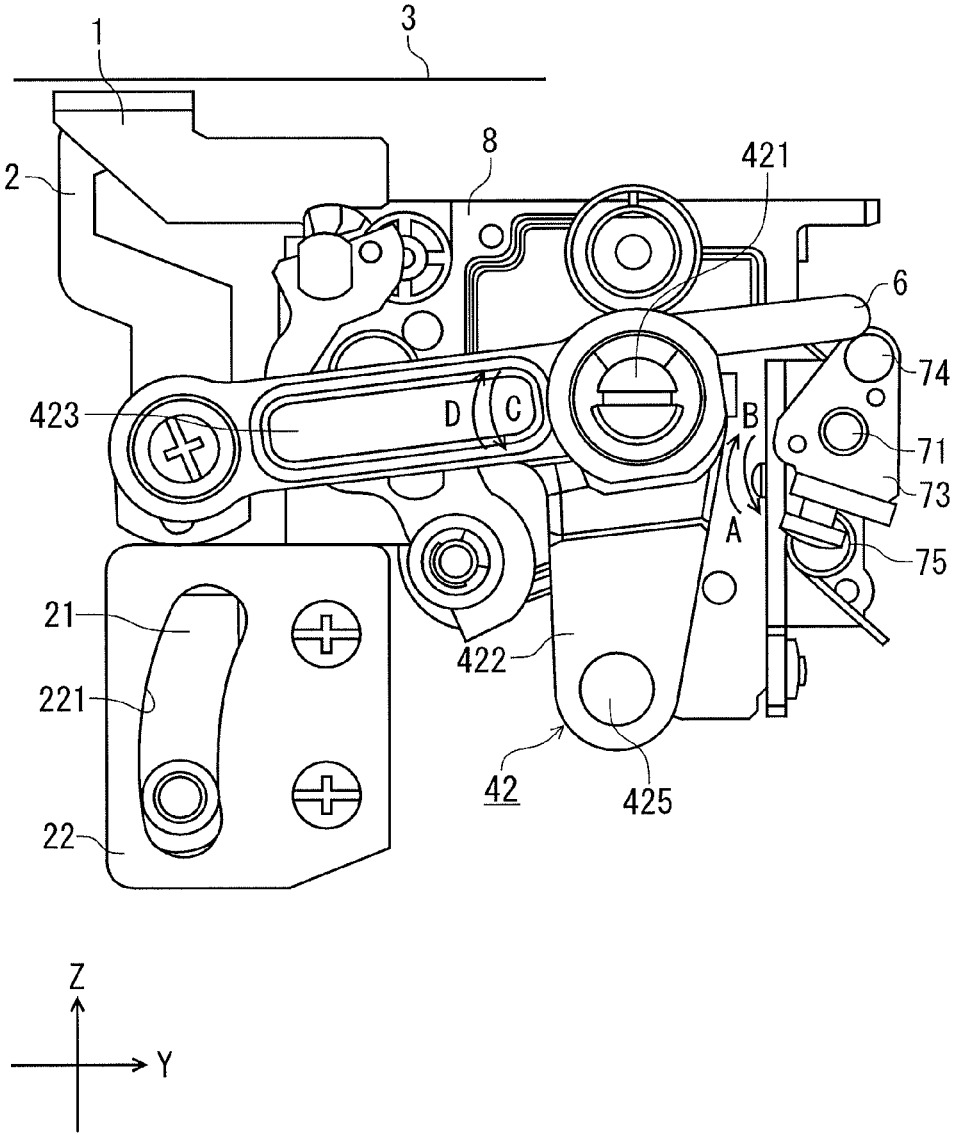
FIG. 8 is a side view showing a state in which the pin portion of the operating unit is in contact with the upper knife position switching unit, to push up it, according to the present embodiment.

FIG. 7 shows a state in which the pin portion 74 of the operating unit 7 is not in contact with the upper knife position switching unit 6. In this state, the upper knife 2 is disposed at a driving position higher than the throat plate 3. Then, when the handle part 711 of the operating unit 7 is operated such that the shaft body 71 and the cam portion 73 rotate in an arrow A direction, the pin portion 74 engages with the upper knife position switching unit 6 according to the rotation. After this engagement, when the shaft body 71 and the cam portion 73 further rotate in the arrow A direction, the pin portion 74 pushes up the upper knife position switching unit 6 as shown in FIG. 8. When the upper knife position switching unit 6 is pushed up, the second link section 42 rotates in an arrow C direction around the rotary shaft 421. With this rotation, the arm portion 423 of the second link section 42 moves the upper knife 2 from the driving position to the withdrawn position. At this time, because biasing force is provided for the cam portion 73 by the coil spring 75, the upper knife position switching unit 6 is restricted from moving downward.

Further, when the handle part 711 of the operating unit 7 is operated such that the shaft body 71 and the cam portion 73 rotate in an arrow B direction, the pin portion 74 is detached from the upper knife position switching unit 6 according to the rotation, to get out of the engagement. At this time, the biasing force in the arrow A direction of the coil spring 75 is released. Thereby, the upper knife position switching unit 6 is lowered, and therefore, the second link section 42 as well rotates in an arrow D direction around the rotary shaft 421. With this rotation, the arm portion 423 of the second link section 42 moves the upper knife 2 from the withdrawn position to the driving position.

Figure 9:
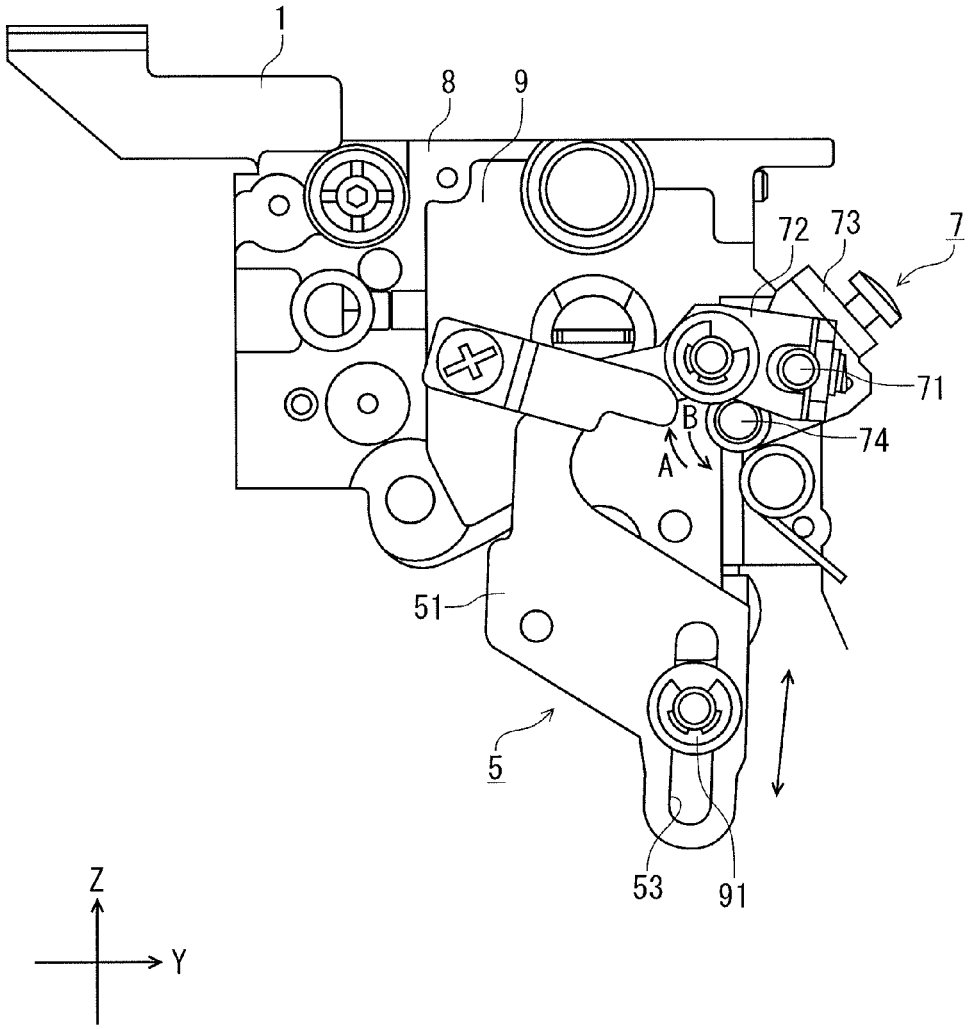
FIG. 9 is a side view showing a schematic configuration of an interlocking switching unit according to the present embodiment.

FIG. 9 is a side view showing a schematic configuration of the interlocking switching unit 5. As shown in FIG. 9, the interlocking switching unit 5 includes a plate-like member 51 which slides in the vertical direction with respect to the frame 9, and a roller 52 (which will be described later) which is integrally attached to the plate-like member 51, and is capable of engaging with the rod 41 according to a slide motion of the plate-like member 51.

The first link section 72 is engaged with the upper portion of the plate-like member 51. Further, the long hole 53 for restricting a vertical movement is formed in the lower portion of the plate-like member 51, and a pin portion 91 provided for the frame 9 is engaged with the long hole 53.

Figure 10:
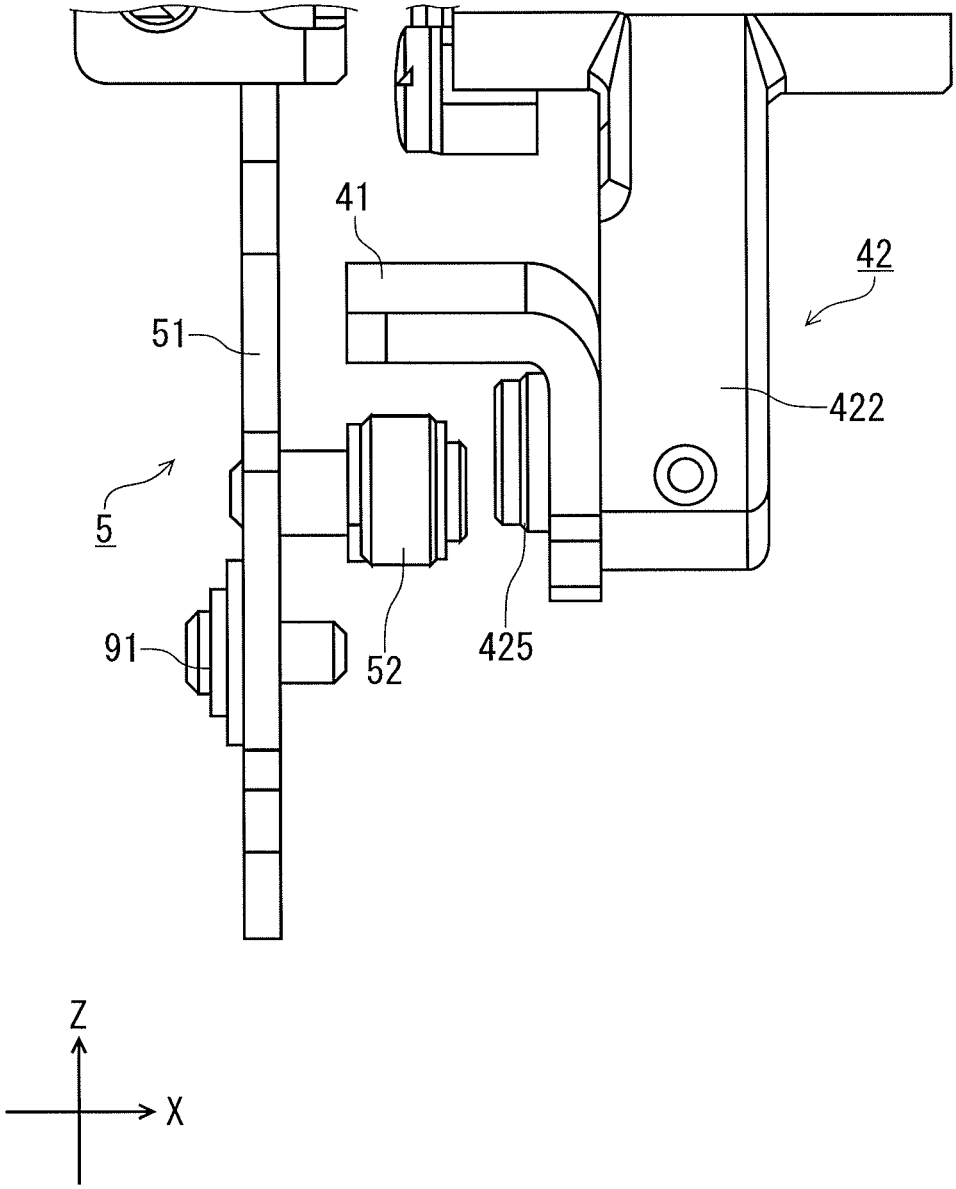
FIG. 10 is an enlarged front view showing an interlocking state in which a notch in the rod and an engaging portion of a second link section are engaged, according to the present embodiment.

FIG. 10 is an enlarged front view showing an interlocking state in which the notch 412 in the rod 41 and the engaging portion 425 of the second link section 42 are engaged. As shown in FIG. 10, in the interlocking state, the plate-like member 51 is disposed at a position at which the roller 52 is separated from the rod 41.

Figure 11:
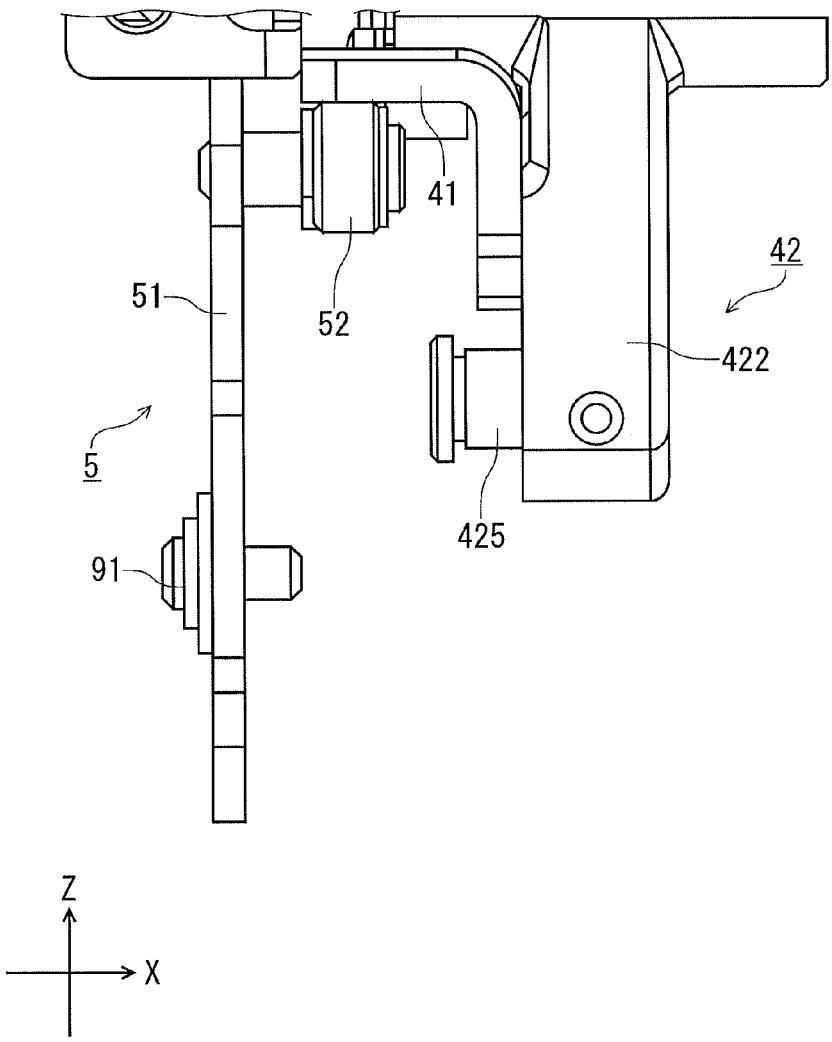
FIG. 11 is an enlarged front view showing a release state in which the notch in the rod and the engaging portion of the second link section are not engaged, according to the present embodiment.

Then, when the handle part 711 of the operating unit 7 is operated such that the shaft body 71 and the first link section 72 rotate in the arrow A direction, the plate-like member 51 is lifted up according to the rotation of the first link section 72. With this lifting-up, the roller 52 is lifted up to move the rod 41 as shown in FIG. 11, and the notch 412 is detached from the engaging part 425, to be brought into a release state.

When the handle part 711 of the operating unit 7 is operated such that the shaft body 71 and the cam portion 73 rotate in the arrow B direction from a release state, the plate-like member 51 is lifted down according to the rotation of the first link section 72. With this lifting-down, the roller 52 is lifted down to move the rod 41 as shown in FIG. 10, and the notch 412 engages with the engaging part 425, to be brought into an interlocking state.

Here, in the case where the upper knife 2 is at the withdrawn position, trouble is brought about if oscillation of the rod 41 is transmitted to the upper knife 2. Therefore, it is necessary to come into a release state in which the interlocking between the upper knife driving unit 4 and the upper knife 2 is released. On the other hand, in the case where the upper knife 2 is at the driving position, it is necessary to transmit the oscillation of the rod 41 to the upper knife 2. Therefore, it is necessary to come into the interlocking state in which the upper knife driving unit 4 and the upper knife 2 is interlocked with one another. The positional relationship between the first link section 72 which puts the interlocking switching unit 5 into motion and the cam portion 73 which puts the upper knife position switching unit 6 into motion with respect to the shaft body 71 is set so as to satisfy the relationship of those.

Next, the operations of the sewing machine 100 of the present embodiment will be described.

First, at the time of cutting a cloth edge, the upper knife 2 is disposed at the driving position, and the upper knife driving unit 4 and the upper knife 2 are in an interlocking state.

Thereafter, when there is no need to use the upper knife 2, an operator operates the handle part 711 of the operating unit 7 such that the shaft body 71, the first link section 72, and the cam portion 73 rotate in the arrow A direction, to move the upper knife 2 to the withdrawn position, and bring the upper knife driving unit 4 and the upper knife 2 into a release state.

When it is necessary to use the upper knife 2 again, the operator operates the handle part 711 of the operating unit 7 such that the shaft body 71, the first link section 72, and the cam portion 73 rotate in the arrow B direction, to move the upper knife 2 to the driving position, and bring the upper knife driving unit 4 and the upper knife 2 into an interlocking state.

As described above, in accordance with the present embodiment, the interlocking switching unit 5 is brought into an interlocking state in a case where the installation position of the upper knife 2 is switched to the driving position by the upper knife position switching unit 6, and the interlocking switching unit 5 is brought into a release state in the case where the installation position of the upper knife 2 is switched to the withdrawn position by the upper knife position switching unit 6. Therefore, in a state in which the upper knife 2 is withdrawn to the lower side of the throat plate 3, the interlocking between the sewing machine main shaft 101 and the upper knife 2 is cut off.

In this release state, because the notch 412 in the rod 41 in the upper knife driving unit 4 is detached from the engaging portion 425 of the second link section 42, to be brought into a non-engaging state, only the rod 41 operates so as to interlock with the sewing machine main shaft 101. In this way, if there is only the rod 41 interlocking with the sewing machine main shaft 101 in a release state, it is possible to suppress the influence on the durability more than the conventional technique.

Then, because members performing power transmission from the sewing machine main shaft 101 to the upper knife 2 are only the rod 41 and the second link section 42, it is possible to reduce the number of components and save space.

Further, because the rotatable roller 52 is provided at the portion contacting the rod 41 in the interlocking switching unit 5, even if the rod 41 oscillates so as to interlock with the sewing machine main shaft 101 in a release state, it is possible to allow friction due to the oscillation to escape by the roller 52.

Further, because the notch 412 is formed in a direction perpendicular to the oscillating direction of the rod 41, in the case where it is switched from a release state to an interlocking state by the interlocking switching unit 5, even if the notch 412 and the engaging portion 425 do not engage with one another at first in the operation, the engaging portion 425 gets into the notch 412 by the oscillation of the rod 41, to be able to be brought into an interlocking state.

Further, because the spring 43 providing biasing force in a direction in which the notch 412 and the engaging portion 425 firmly adhere to one another, is provided for the rod 41, it is possible to strengthen the engagement between the both by the biasing force of the spring 43 when the notch 412 and the engaging portion 425 are engaged, and it is possible to ensure power transmission from the sewing machine main shaft 101 to the upper knife 2.

In addition, the present invention is not limited to the above-described first embodiment, and may be appropriately changed.

For example, the configuration of the present invention is applicable to a sewing machine having a mechanism in which the upper knife 2 and the lower knife 1 are movable in the X direction in order to adjust a darning width.

What is claimed is:

1. An overlock sewing machine comprising:

an upper knife that is movable to a withdrawn position lower than a throat plate or a driving position higher than the withdrawn position, and that moves up and down from above a workpiece on the throat plate to cut the workpiece at the driving position;

an upper knife driving unit that moves the upper knife up and down at the driving position;

an interlocking switching unit that switches between an interlocking state in which the upper knife driving unit and the upper knife interlock with one another and a release state in which interlocking between the upper knife driving unit and the upper knife is released;

an upper knife position switching unit that switches an installation position of the upper knife to the driving position or the withdrawn position; and an operating unit that simultaneously drives the interlocking switching unit and the upper knife position switching unit such that the interlocking switching unit is brought into the interlocking state in a case where the installation position of the upper knife is switched to the driving position by the upper knife position switching unit, and such that the interlocking switching unit is brought into the release state in a case where the installation position of the upper knife is switched to the withdrawn position by the upper knife position switching unit, wherein the operating unit includes:

a rotatable shaft body;

a first link section that rotates along with the shaft body in a state of engaging with the interlocking switching unit, to put the interlocking switching unit into motion; and a cam portion that rotates along with the shaft body, and that engages with the upper knife position switching unit, to put the upper knife position switching unit into motion, the upper knife driving unit includes:

a rod that is provided with an eccentric cam rotating along with a sewing machine main shaft at one end portion, that has a notch in the other end portion, and that oscillates by a rotation of the eccentric cam according to a rotation of the sewing machine main shaft; and a second link section that has an engaging portion which is capable of engaging with the notch of the rod, and that oscillates so as to follow oscillation of the rod in a state in which the engaging portion engages with the notch, to drive the upper knife, the upper knife position switching unit moves the second link section so as to move the upper knife from the driving position to the withdrawn position when the cam portion engages with the upper knife position switching unit, and so as to move the upper knife from the withdrawn position to the driving position when the cam portion gets out of the engagement, and when the interlocking switching unit is driven by the first link section, the interlocking switching unit moves the rod so as to detach the notch from the engaging portion to bring the interlocking switching unit into the release state, and so as to bring the notch to engage with the engaging portion to bring the interlocking switching unit into the interlocking state.

2. The overlock sewing machine according to claim 1, wherein a rotatable roller is provided at a portion contacting the rod in the interlocking switching unit.

3. The overlock sewing machine according to claim 1, wherein a biasing unit is provided for the rod to provide biasing force in a direction in which the notch and the engaging portion firmly adhere to one another.

4. The overlock sewing machine according to claim 2, wherein a biasing unit is provided for the rod to provide biasing force in a direction in which the notch and the engaging portion firmly adhere to one another.

* * * * *